United States Patent [19]

Akatsuka et al.

[11] Patent Number: 4,563,991

[45] Date of Patent: Jan. 14, 1986

[54] ENGINE AIR/FUEL RATIO CONTROL METHOD AND SYSTEM SELECTIVELY PROVIDING FEEDBACK CONTROL OR OPEN LOOP CONTROL ACCORDING TO OXYGEN SENSOR HEATING CONDITION

[75] Inventors: Takao Akatsuka; Jiro Nakano; Takao Ishibashi; Masao Kawaguchi, all of Toyota, Japan

[73] Assignee: Toyota Jidosha Kabushiki Kaisha, Toyota, Japan

[21] Appl. No.: 666,465

[22] Filed: Oct. 30, 1984

[30] Foreign Application Priority Data

May 7, 1984 [JP] Japan ..... 59-090675

[51] Int. Cl.[4] ..... F02B 3/00

[52] U.S. Cl. ..... 123/440; 123/491

[58] Field of Search ..... 123/440, 489, 491; 204/195 S

[56] References Cited

U.S. PATENT DOCUMENTS

| | | | |
|---|---|---|---|
| 4,022,171 | 5/1977 | Laprade | 123/440 |
| 4,132,200 | 1/1979 | Asano | 123/440 |
| 4,177,770 | 12/1979 | Anderson | 123/440 |
| 4,208,990 | 6/1980 | Asano | 123/440 |
| 4,356,065 | 10/1982 | Dietz | 204/1 T |

*Primary Examiner*—Ronald B. Cox

*Attorney, Agent, or Firm*—Kenyon & Kenyon

[57] ABSTRACT

An internal combustion engine has an exhaust system and an oxygen sensor fitted to the exhaust system including a sensor element and an electrically powered heater for heating the sensor element. A method is disclosed for controlling the air/fuel ratio of the air-fuel mixture supplied to the engine, by, when the voltage of the power supply to the heater has dropped below a first predetermined value and thereafter has remained below a second predetermined value higher than the first predetermined value for longer than a predetermined time period, controlling the air/fuel ratio according to engine operational parameters by an open loop form of control with no account being taken of the output signal of the oxygen sensor, and otherwise controlling the air/fuel ratio according to these engine operational parameters by a closed loop form of control taking into account the output signal of the oxygen sensor so as to obtain an optimum air/fuel ratio for the engine by a feedback control process. Accordingly it is ensured that the air/fuel ratio of the engine is kept appropriate, even if the voltage of the battery drops so low that it can no longer properly power the oxygen sensor heater, which causes the output signal of the oxygen sensor to be no longer reliable for indicating the amount of oxygen in the exhaust gases of the engine. A system is also described for implementing this method.

4 Claims, 5 Drawing Figures

ENGINE AIR/FUEL RATIO CONTROL METHOD AND SYSTEM SELECTIVELY PROVIDING FEEDBACK CONTROL OR OPEN LOOP CONTROL ACCORDING TO OXYGEN SENSOR HEATING CONDITION

BACKGROUND OF THE INVENTION

The present invention relates to a method of controlling air/fuel ratio of an internal combustion engine, and to a system for practicing the method. More particularly, the present invention relates to such a method and device for controlling air/fuel ratio which provide either closed loop control or open loop control for said air/fuel ratio, according as to whether an oxygen sensor provided to the exhaust system of said engine is properly being kept warm by a heater which is built into it, or not.

It is known to fit an oxygen sensor to the exhaust system of an internal combustion engine. Such an oxygen sensor typically comprises a solid electrolyte or semiconductor, and varies a generated current or resistance in response to the concentration of oxygen in the exhaust gases of the engine. This electrical signal is fed to a control device which controls the amount of fuel provided to the engine in relation to the amount of air sucked thereinto, and is used for controlling the air/fuel ratio of the air-fuel mixture supplied to the engine by a closed loop or feedback process. Various such forms of control device, which practice various methods of air-fuel mixture ratio control, are per se known.

The output of the sensor element of such an oxygen sensor varies with temperature, and, particularly when the air/fuel ratio is weak and is in the range of 17 to 25, in order for the sensor element to accurately measure the oxygen concentration, said sensor element must be maintained at a temperature higher than a certain critical minimum active temperature. This maintenance of the temperature of the sensor element can be done by using a heater, and oxygen sensors with built in sensor element heaters have already been proposed, along with methods for operation of such heaters; for example in Japanese Patent Application No. 53-78476, which has been published as Japanese Patent Publication No. 54-13396. Further, in Japanese Patent Application No. 53-83120, which has been published as Japanese Patent Publication No. 54-21393, there has been proposed a method and a system for control of the electrical power supplied to such an oxygen sensor element heater, in which the power is varied as a function of intake manifold pressure, of throttle opening, and of engine revolution speed, so as to ensure that the oxygen sensor element is kept at a temperature no lower than its minimum active temperature.

The sensor element of such an oxygen sensor fitted to an exhaust system is of course heated up by the exhaust gases in the exhaust system, so the effect of a heater for the sensor element must be controlled to take account of the temperature of these exhaust gases. Now, in an internal combustion engine which is controlled by a throttle valve, the exhaust temperature is largely determined by the amount of air-fuel mixture supplied per engine piston stroke and by engine revolution speed, and if the air/fuel ratio of the air-fuel mixture is constant the amount of such mixture supplied is proportional to the rate of intake air flow. Therefore, in the above mentioned patent applications, the above are used as parameters, and the supply of electricity to the sensor element heater is varied depending on the engine load and the engine revolution speed. Thus, the exhaust temperature is considered to depend on the engine intake flow and engine revolution speed, and the values are determined experimentally in advance with reasonable accuracy. This method and system are adequate to keep the temperature of the sensor element of the oxygen sensor reasonably constant regardless of engine operational conditions, provided however that these engine operational condition do not change too abruptly.

However, when the battery voltage drops to too low a level, this method and system do not provide satisfactory operation. This is because, if a fixed or constant voltage is being applied to the sensor element, and also the temperature of the sensor element is kept constant, then the sensor current increases along with an increase in the oxygen concentration in the exhaust gases of the engine; while, on the other hand, if the voltage applied to the sensor element and the oxygen concentration in the exhaust gases remain fixed, while the temperature of the sensor element drops, then the current through the sensor element also drops. Accordingly, if the battery voltage drops so far that the temperature of the sensor element drops substantially due to the loss of heating power of the heater therefor, then, if closed loop feedback type air/fuel ratio control for the engine is still employed, the control system will think that the concentration of oxygen in the engine exhaust gases is lower than it really is, in other words that the air/fuel ratio of the engine is lower than it really is, and based upon this erroneous determination the control system will therefore control the air/fuel ratio of the air-fuel mixture supplied to the engine to be weaker than in fact it ought to be. This may bring the leanness of the air-fuel mixture for the engine beyond the region of combustibility, and may deteriorate the engine operation.

However, the temperature of the sensor element of the oxygen sensor does not directly correspond to the voltage of the battery source of electrical power for the heater element for the oxygen sensor. The reason for this is that the oxygen sensor as a whole has a certain thermal inertia, and therefore, if the battery voltage for a short transient period dips below an acceptable level, no problem will be caused with regard to the operation of the sensor element of the oxygen sensor, or to the control of the engine. Any system which aims at considering when the oxygen sensor element has cooled down so far as to not provide a reliable exhaust gas oxygen concentration signal must take into account this thermal inertia.

Yet further, the operation of any such system must be positive and stable; in other words, the system must not be prone to fall into any fluctuation condition. Also, since operation of the internal combustion engine in a closed loop feedback mode as described above provides much better air/fuel ratio control than any form of open loop control, such open loop control should only be performed to the minimum amount possible. This in any event is desirable in order to minimize fuel consumption, since such open loop control, in order to ensure satisfactory engine operability, typically provides a lower air/fuel ratio than does closed loop control.

SUMMARY OF THE INVENTION

Accordingly, it is the primary object of the present invention to provide a method and system for internal combustion engine air/fuel ratio control, which take into account the circumstance that the temperature of the oxygen sensor element may become so low that its output signal cannot be relied upon.

It is a further object of the present invention to provide such a method and system for air/fuel ratio control, which stop closed loop air/fuel ratio control when the output signal of the oxygen sensor becomes unreliable.

It is a further object of the present invention to provide such a method and system for air/fuel ratio control, which perform open loop air/fuel ratio control is such circumstances when the output signal of the oxygen sensor becomes unreliable.

It is a further object of the present invention to provide such a method and system for air/fuel ratio control, which reduce the possibility that the air/fuel ratio of the air-fuel mixture supplied to the engine should become too high.

It is a further object of the present invention to provide such a method and system for air/fuel ratio control, which minimize the occurrence of such open loop air/fuel ratio control operation.

It is a further object of the present invention to provide such a method and system for air/fuel ratio control, which consider the heating power of the voltage produced by the battery power source, in its effect for keeping the oxygen sensor element hot by means of the heater therefor.

It is a further object of the present invention to provide such a method and system for air/fuel ratio control, which further take into account the thermal inertia of the oxygen sensor.

It is a further object of the present invention to provide such a method and system for air/fuel ratio control, which avoid the risk of operating the engine with too high an air/fuel ratio.

It is a yet further object of the present invention to provide such a method and system for air/fuel ratio control, which maintain the fuel consumption to be as good as possible.

It is a yet further object of the present invention to provide such a method and system for air/fuel ratio control, which maintain the engine operation to be as good as possible.

It is a yet further object of the present invention to provide such a method and system for air/fuel ratio control, which maintain the combustibility of the air-fuel mixture to be as good as possible.

It is a yet further object of the present invention to provide such a method and system for air/fuel ratio control, which operate stably. It is a yet further object of the present invention to provide such a method and system for air/fuel ratio control, which operate with a certain operational hysteresis.

According to the most general method aspect of the present invention, these and other objects are accomplished by, for an internal combustion engine comprising an exhaust system and an oxygen sensor fitted to said exhaust system comprising a sensor element and an electrically powered heater for heating said sensor element: a method for controlling the air/fuel ratio of the air-fuel mixture supplied to said engine, wherein: when the voltage of the power supply to said heater has dropped below a first predetermined value and thereafter has remained below a second predetermined value higher than said first predetermined value for longer than a predetermined time period, said air/fuel ratio is controlled according to engine operational parameters by an open loop form of control with no account being taken of the output signal of said oxygen sensor; while, otherwise, said air/fuel ratio is controlled according to engine operational parameters by a closed loop form of control taking into account the output signal of said oxygen sensor, so as to obtain an optimum air/fuel ratio for the engine by a feedback control process; and, according to the most general apparatus aspect of the present invention, these and other objects are accomplished by, for an internal combustion engine comprising an exhaust system and an oxygen sensor fitted to said exhaust system comprising a sensor element and an electrically powered heater for heating said sensor element: a system for controlling the air/fuel ratio of the air-fuel mixture supplied to said engine, comprising: a first means for controlling said air/fuel ratio according to engine operational parameters by an open loop form a control with no account being taken of the output signal of said oxygen sensor; a second means for controlling said air/fuel ratio according to engine operational parameters by a closed loop form of control taking into account the output signal of said oxygen sensor, so as to obtain an optimum air/fuel ratio for the engine by a feedback control process; and a means for, when the voltage of the power supply to said heater has dropped below a first predetermined value and thereafter has remained below a second predetermined value higher than said first predetermined value for longer than a predetermined time period, employing said first means for controlling said air/fuel ratio, and otherwise employing said second means for controlling said air/fuel ratio.

According to such a method and such a system, when the voltage of the power supply to the heater drops below said first predetermined value and stays thereafter below said second predetermined value for longer than said predetermined time period, it is taken that said power supply has lost voltage to the extent that by now it can no longer be powering said heater so as properly to be heating up said oxygen sensor, and accordingly, if the output signal from said oxygen sensor is continued to be used as an indication of oxygen concentration in the exhaust gases of said engine for a closed loop form of air/fuel ratio control, there is a risk of poor air/fuel ratio control, and of controlling the air/fuel ratio of the air-fuel mixture supplied to said engine to be weaker than is desirable. Accordingly, according to the present method and system, in these circumstances the form of air/fuel ratio control is altered, so as to be now an open loop form of air/fuel ratio control which does not take into account the output signal from said oxygen sensor as an indication of oxygen concentration in the exhaust gases of said engine. Thus, the engine is operated in open loop air/fuel ratio control mode, until the above condition ceases to be so, in other words, until the battery voltage rises again to be above said second predetermined value; and when this happens closed loop feedback type air/fuel ratio control is resumed. The use of two such threshold values for the battery voltage, i.e. the use of the first and second predetermined values with the second such value larger than the first, is in order to provide stable system operation with a certain degree of operational hysteresis. In the open loop form of air/fuel ratio control operation, the air/fuel ratio of the air-fuel mixture supplied to the engine may be lower, and accordingly the fuel consumption may be lowered, as compared with closed loop feedback type operation; but the use of the present invention keeps such open loop operation to the minimum practicable.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENT

Figure 1:
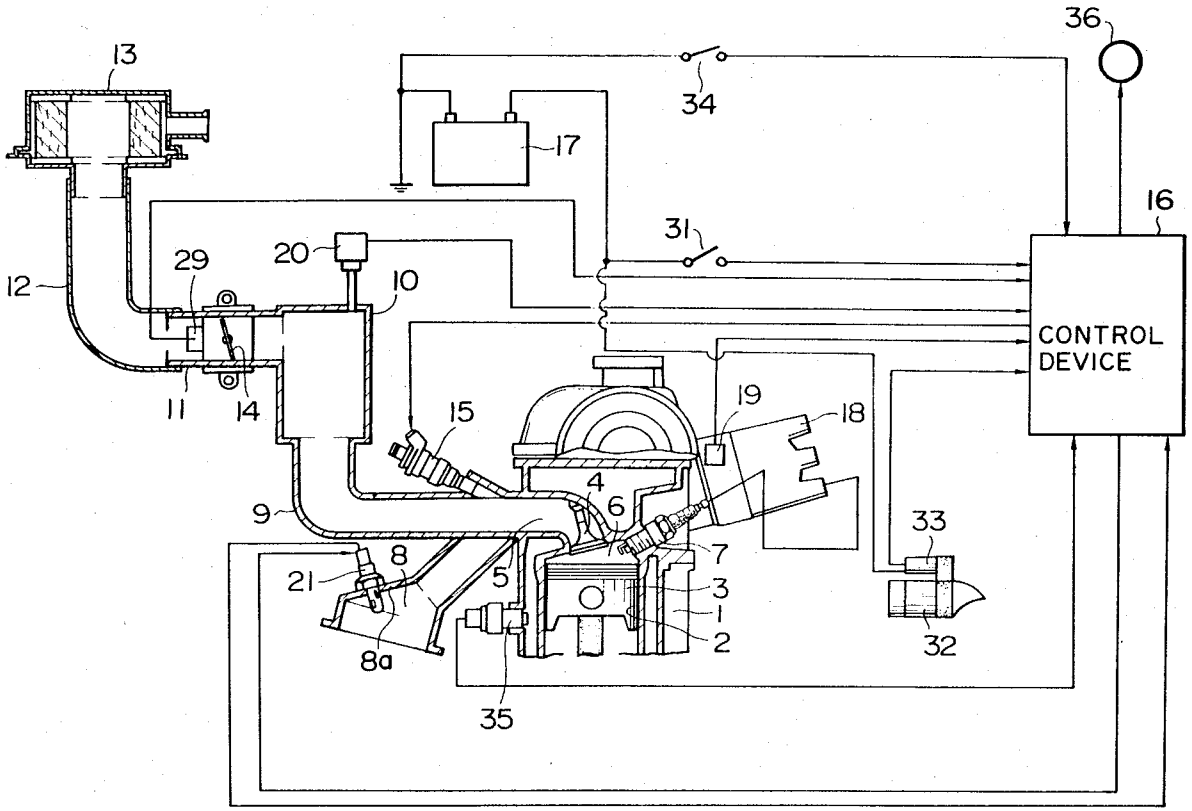
FIG. 1 is a partly schematic partly sectional view of an internal combustion engine which is equipped with the preferred embodiment of the oxygen sensor heating control system of the present invention, also showing various ancillary elements thereof.

FIG. 1 shows in schematic view an internal combustion engine with an oxygen sensor of the above described kind, said engine incorporating the preferred embodiment of the oxygen sensor heating control system of the present invention, for performing the preferred embodiment of the oxygen sensor heating control method of the present invention. In this figure, the internal combustion engine 1 has a cylinder bore 2 within which a piston 3 reciprocates, said piston 3 being coupled in a per se conventional manner to a crankshaft, not shown, by a connecting rod, only partially shown; in fact the engine 1 has a plurality of such cylinders and pistons but only one of each of them can be seen in the figure. A combustion chamber 6 is defined above the piston 3 in the figure in the cylinder bore 2, between it and a cylinder head, and an intake port 5 opens to this combustion chamber 6 via a valve aperture the opening and closing of which is controlled by an intake valve 4. A per se conventional spark plug 7 provides ignition for air-fuel mixture in the combustion chamber 6 when appropriately energized. Further, an exhaust port, not shown in the figure, opens to the combustion chamber 6 via a valve aperture the opening and closing of which is controlled by an exhaust valve, also not shown, and to this exhaust port there is connected an exhaust system, only a portion of an exhaust manifold 8 incorporated in which is shown.

To the inlet port 5 there is connected the downstream end of an intake manifold 9, the upstream end of which is connected to the outlet of a surge tank 10. To the inlet of the surge tank 10 there is connected the downstream end of a throttle body 11, the upstream end of which is connected to the downstream end of an inlet tube 12. The upstream end of this inlet tube 12 is communicated to the outlet of an air cleaner 13, the inlet of which is left open to the atmosphere. In the throttle body 11 there is mounted an intake butterfly valve 14 the opening and closing action of which for intake air amount control is linked to the foot depression movement of a throttle pedal for the engine 1, not shown, by a throttle pedal linkage also not shown.

To the intake manifold 9 there is mounted a per se conventional fuel injection valve 15 which incorporates a solenoid **15*a* (not shown particularly in FIG. 1), and this fuel injection valve 15 is supplied with pressurized fuel (i.e. gasoline) by a fuel supply system which is not shown. The opening and closing action of this valve 15 is electronically controlled by a control device 16 which will be more particularly described hereinafter. Thus, the valve 15 squirts spirts of fuel into the intake manifold 9 the total volume of each of which depends on the opening and closing times thus provided for said fuel injection valve 15 by the control device 16**.

The control device 16 is supplied with actuating electrical energy from the battery 17 of the vehicle to which this engine 1 is fitted, via an ignition switch 31. To the distributor 18 of the engine 1 there is fitted a crank angle sensor 19, the electrical output signal of which is representative of the position of the crankshaft of the engine 1 and is dispatched to the control device 16. To the surge tank 10 of the engine 1 there is fitted an intake pressure sensor 20, the electrical output signal of which is representative of the air pressure in the intake system of the engine 1 and is also dispatched to the control device 16. To the wall **8*a* of the exhaust manifold 8 of the engine 1 there is fitted an oxygen sensor 21 to be more particularly described later, the electrical output signal of which is representative of the oxygen concentration in the exhaust gases flowing through said exhaust manifold 8 and is also dispatched to the control device 16; and the oxygen sensor 21 further has a heater 28 as will be described later, supply of actuating electrical energy to which is provided from the control device 16. To the throttle valve 14 mounted in the intake system of the engine 1 there is fitted a throttle valve idling opening amount sensor 29 incorporating a switch 29*a* (not shown particularly in FIG. 1), the electrical output signal of which is also dispatched to the control device 16 and is representative of the opening amount of said throttle valve 14, being ON when said throttle valve 14 is opened by more than a predetermined amount and thus indicating engine operation at a level higher than idling level and being OFF when the throttle valve 14 is opened by less than said predetermined amount and thus indicating engine idling operation. To the starter 32 of the engine 1 there is fitted a starter switch 33, an electrical output signal from which is indicative of whether said starter 32 is being actuated to crank said engine 1 or not and is also dispatched to the control device 16. And to the water jacket of the engine 1 there is fitted a water temperature sensor 35, the electric output signal of which is indicative of the temperature of the cooling water of said engine 1 and is also dispatched to the control device 16. Further, a test switch 34 optionally provides earthing for a terminal of the control device 16, and an output signal from said control device 16 is fed to a test alarm lamp 36**.

Figure 2:
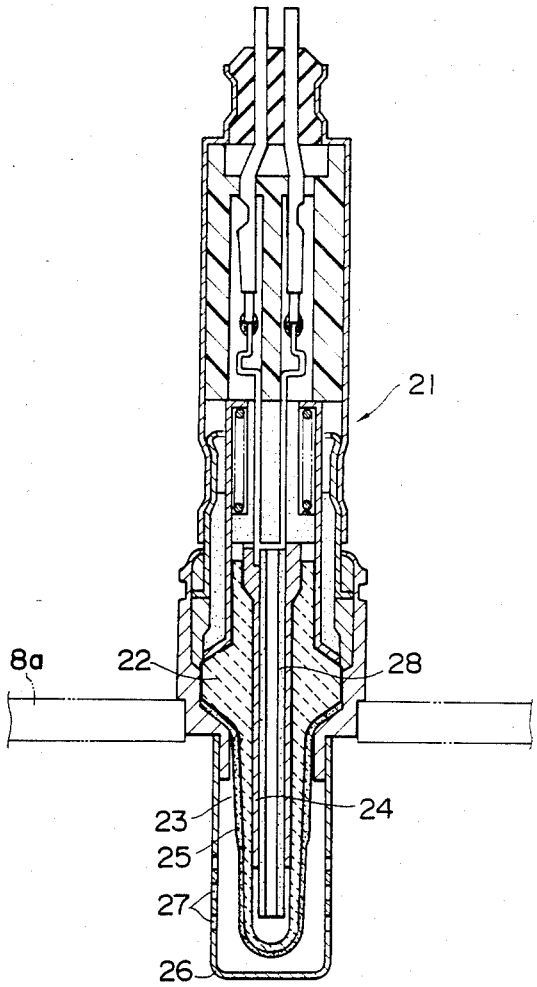
FIG. 2 is a longitudinal sectional view of an oxygen sensor fitted to the engine of FIG. 1 and shown in said figure, said oxygen sensor having a heater for keeping its sensor element at an appropriate operating temperature.

Referring to FIG. 2, the oxygen sensor 21 fitted in the wall 8*a* of the exhaust manifold 8 comprises a sensor element 22 formed as a tube with one end closed and made of a solid electrolyte material such as zirconia which can transmit oxygen ions. The outside of this sensor element 22 has, laid on it, an outer electrode 23 formed as a porous thin conducting layer (this layer is not clearly separately shown in the figure because it is so thin as to be represented by a single line), and the inside of said sensor element 22 has, likewise laid on it, an inner electrode 24 likewise formed as a porous thin conducting layer (again, this layer is shown only by a single line in FIG. 2). The outer surface of the outer electrode 23 has an exhaust gas dispersion layer 25 also laid on it, said layer 25 being formed of porous ceramic. The sensor element 22, etc., are mounted within a casing and so on, not particularly desribed here because they are per se known, and are fixed into the wall 8*a* of the exhaust manifold 8 with their lower parts in FIG. 2 projecting into the interior of said exhaust manifold 8. And a shield 26 with a plurality of holes 27 formed therein is provided around said lower ends of the sensor element 22 etc. projecting into the exhaust manifold 8, so as to protect them from the impact of the rushing flow of exhaust gases in the exhaust manifold 8, while allowing said exhaust gases to impinge gently on the exhaust gas dispersion layer 25 and the outer electrode 23 to reach the sensor element 22. During use of this oxygen sensor 21 as a current limiting type lean sensor, a certain voltage is applied by the control device 16 between the outer electrode 23 and the inner electrode 24, so that the current between these electrodes increases approximately in proportion to the oxygen concentration in the exhaust gases flowing through the exhaust manifold 8, within certain limits, as is per se well known. And, in order to keep the sensor element 22 etc. at the correct temperature for activation, an electrical heater 28 is provided for the oxygen sensor 21. This heater 28 is a per se known type of resistive heater, and the magnitude of the heating power instantaneously provided thereby is proportional to the product of the voltage and the amperage being provided by the control device 16 thereto.

The function of the control device 16 is in partial outline as follows. From the data it receives relating to engine rotational speed from the crank angle sensor 19 and relating to intake manifold pressure from the intake manifold pressure sensor 20, it determines the volume of intake air which is being sucked into the combustion chamber in each intake stroke of the piston 3, and according thereto determines a theoretically proper amount of fuel to be mixed with this intake air to provide a proper and appropriate target value for the air/fuel ratio of the air-fuel mixture in the combustion chamber. And, during normal engine operation when the voltage of the battery 17 is adequate to keep the oxygen sensor element 22 warmed up and when the engine 1 has been warmed up as is indicated by the output of the engine cooling water temperature sensor 35, based upon the actual value of the oxygen concentration in the exhaust gases in exhaust manifold 8 of the engine 1 as detected by the oxygen sensor 21, information regarding which is dispatched therefrom to the control device 16, said control device 16 makes a correction to this theoretical value in order to produce a value for the actual amount of fuel to be injected, so as to bring the air/fuel ratio to its target value by a form of per se known feedback control. Then, the control device 16 produces electrical output signals at appropriate crank angles and supplies them to the solenoid 15*a* of the fuel injector 15, so as to control the opening and closing of the fuel injector 15 so as to inject this determined appropriate amount of fuel, in each injection spirt. On the other hand, when the engine 1 has not yet properly been warmed up as is again indicated by the output of the engine cooling water temperature sensor 35, or as will be explained later, according to the present invention, when the voltage Vi of the battery 17 is judged to be so inadequate that the heater element 22 is not properly warmed up, no such feedback correction according to exhaust oxygen concentration of the calculated theoretically proper amount of fuel to be injected in order to provide a proper and appropriate target value for the air/fuel ratio of the air-fuel mixture in the combustion chamber is made, but instead the theoretically calculated value is directly used as a value of fuel to be injected, and accordingly the control of fuel injection is by a form of open loop control without any feedback. At this time the air/fuel ratio is controlled to be smaller than in the warmed up engine case when feedback is being utilized.

Figure 3:
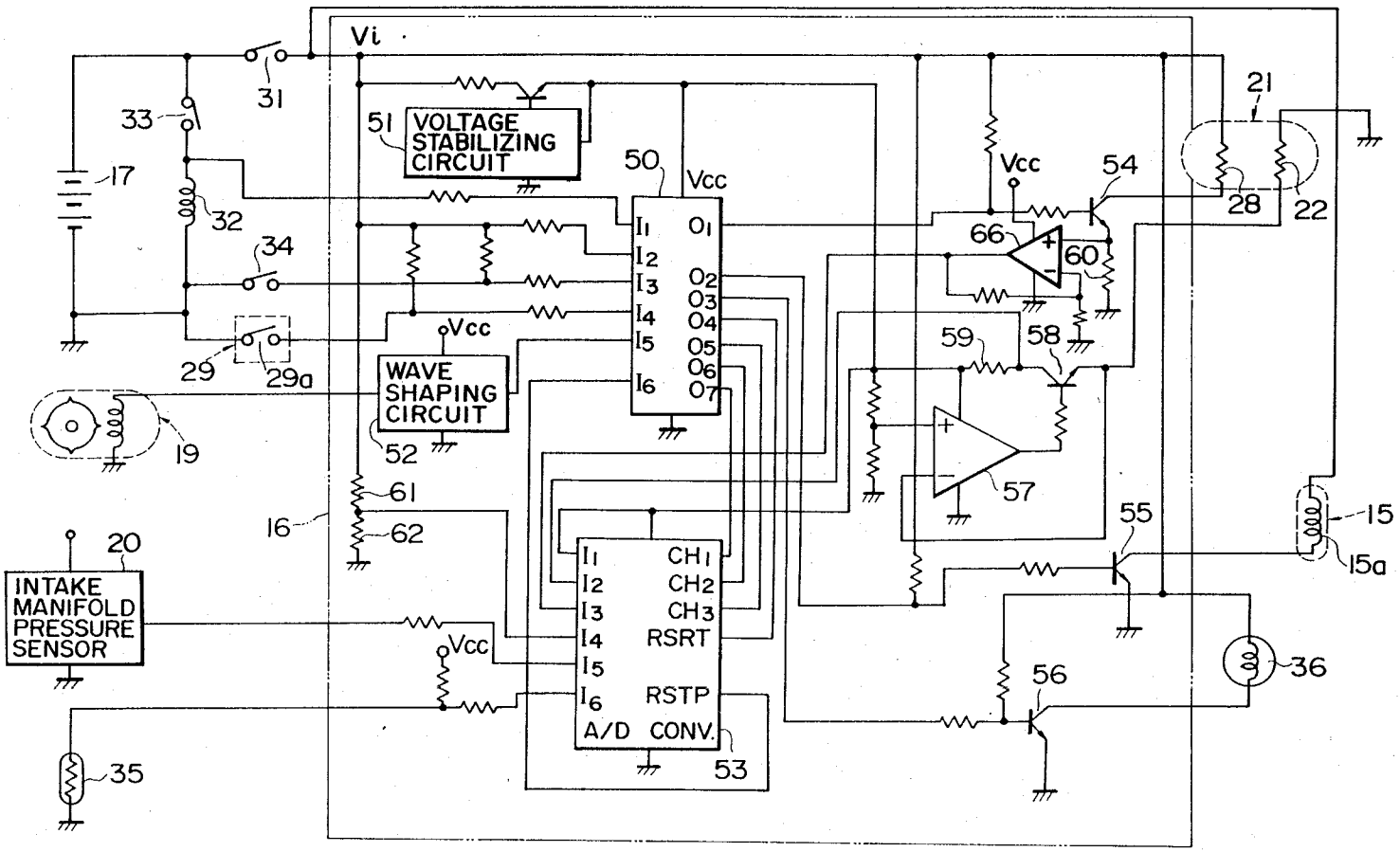
FIG. 3 is a partial circuit diagram of the preferred embodiment of the oxygen sensor heating control system of the present invention, and of various ancillary elements thereof, and particularly showing a microcomputer incorporated in said control system.

Referring to FIG. 3, herein the internal structure of the control device 16 is partially shown as an electrical circuit diagram, and also ancillary circuits relating thereto are shown. This control device 16 comprises a microcomputer 50, which may be for example of the Motorola 6801 type, and this microcomputer 50 is powered, like other parts of the circuitry of the control device 16, by a constant voltage Vcc supplied by a voltage regulator circuit 51 of a per se well known type, when and only when the ignition switch 31 of the vehicle is ON. This microcomputer 50 of this preferred embodiment has six inputs designated in the figure as I1 through I6 and seven outputs designated as O1 through O7. The inputs I1 through I6 are connected as follows. The input I1 receives an ON signal when and only when the starter switch 33 is in the ON state. The input I2 receives an ON signal when and only when the ignition switch 31 of the vehicle is in the ON state. The input I3 receives an ON signal when and only when the test switch 34 is in the OFF state. The input I4 receives an ON signal when and only when the switch 29*a* incorporated in the throttle valve idling opening amount sensor 29 is in the OFF state, i.e. when and only when the engine 1 is not idling. The input I5 receives the output of the crank angle sensor 19, after this has been converted to a square wave by a wave shaping circuit 52. And the input I6 receives a pulse width signal from a RSTP terminal of an A/D converter (an analog-digital converter) 53 of a per se well known sort. Further,-the outputs O1 through O7 are connected as follows. The signal from the output O1 is furnished to the base of a transistor 54 as a pulse signal, so as to control the power supplied to the heater 28 of the oxygen sensor 21 as will be explained hereinafter. The signal from the output O2 is furnished to the base of a transistor 55 as a pulse signal, so as to control the solenoid 15*a* of the fuel injector 15 for providing fuel injection. The signal from the output O3 is furnished to the base of a transistor 56 as a sensor diagnostic result signal, so as to selectively energize the test alarm lamp 36 according to the result of circuit testing, as will be explained hereinafter. The signal from the output O4 is furnished to a convert control terminal RSRT of the A/D converter 53 as a convert start signal. And the signals from the outputs O5 through O7 are furnished as channel control signals to the channel control terminals CH1 through CH3 respectively of said A/D converter 53.

The transistor 54 receives the pulse signal from the output O1 of the microcomputer 50 at its base, and is thereby selectively switched ON so as to provide power via its collector to the heater 28 of the oxygen sensor 21, when and only when said pulse signal from said output O1 is ON. This power for the heater 28 is provided directly from the battery 17 via the ignition switch 31, i.e. not via the voltage regulation circuit 51. The transistor 5 receives the pulse signal from the output O2 of the microcomputer 50 at its base, and is thereby selectively switched ON so as to provide power via its collector to the solenoid coil 15*a* of the fuel injector 15, when and only when said pulse signal from said output O2 is ON. And the transistor 56 receives the signal from the output O3 of the microcomputer 50 at its base, and is thereby selectively switched ON so as to provide power via its collector to the test alarm lamp 36, when and only when said signal from said output O3 is ON. And the reference numeral 57 denotes a differential amplifier: when the ignition switch 31 is ON, then a constant voltage Vcc is provided via the voltage regulation circuit 51, and drives the transistor 58 to supply a constant voltage to the sensor element 22 of the oxygen sensor 21.

The A/D converter 53 comprises a multiplexer, not particularly shown, and is powered by the constant voltage Vcc supplied by the voltage regulator circuit 51. This A/D converter 53 of this preferred embodiment has six inputs designated as I1 through I6, as well as a control terminal RSRT and an output terminal RSTP and channels CH1 through CH3. The inputs I1 through I6 are connected as follows. The input I1 receives the reference voltage signal Vcc. The input I2 receives a voltage signal dropped from this reference voltage Vcc by a variable amount which depends upon the current through the sensor element 22 of the oxygen sensor 21 because of the resistor 59 as shown in the circuit diagram of FIG. 3. The input I3 receives a voltage signal amplified by a differential amplifier 66 from the voltage across a load dropping resistor 60, thus detecting the value of the current passing through the heater 28 of the oxygen sensor 21. The input I4 receives a voltage signal proportional to the current value of the voltage Vi being supplied by the battery 17, according to the operation of a voltage divider circuit incorporating two resistors 61 and 62. The input I5 receives a voltage signal representative of the pressure in the surge tank 10 of the engine intake system from the intake pressure sensor 20. And the input I6 receives a voltage signal representative of the temperature of the cooling water of the engine 1 from the engine cooling water temperature sensor 35.

Thus during operation by using a combination of the CH1 through CH3 signals from the microcomputer 50 a particular one of the input signals I1 through I6 is selected, and then, when the "start A/D convert" signal is dispatched by the microcomputer 50 (from its output O4) and is received at the RSRT terminal of the A/D converter 53, said A/D converter 53 performs the analog-digital conversion process and outputs a pulse width signal corresponding to the voltage of the selected input from its output terminal RSTP to the input I6 of the microcomputer 50. In particular, the microcomputer 50 receives pulse width signals from the A/D converter 53 which are together representative of the voltage across the current detecting resistor 59 for the sensor element 22 of the oxygen sensor 21, said signals being received by said A/D converter 53 at its I1 and I2 input terminals; and, by converting these pulse width signals into digital values and by subtracting one of them from the other, the mirocomputer 50 can obtain a digital value representative of said voltage across said sensor element 22. This value, which is representative of the oxygen concentration in the exhaust gases flowing through the exhaust manifold 8, is the value that the microcomputer 50 uses for performing the above described feedback control of the air/fuel ratio of the air-fuel mixture supplied to the engine 1, when in fact such feedback control is to be performed.

Now, in brief, the operation of the microcomputer 50 during this action of performing control of the air/fuel ratio of the air-fuel mixture supplied to the engine 1 is as follows. The microcomputer 50 determines the current value of engine rotational speed from the signals from the crank angle sensor 19, and determines the current value of manifold pressure from the intake manifold pressure sensor 20, and then, as well as determining the proper amount of fuel to be injected into the cylinders of the engine 1 in each fuel injection spirt as has been explained previously, and as well as actually implementing the injection of this proper fuel injection amount, said microcomputer 50, by a table lookup process or the like, determines a value Wh for the power to be supplied to the heater 28 of the oxygen sensor 22. Also, the input I3 of the A/D converter 53 as specified above receives the voltage signal amplified by the differential amplifier 66 from the voltage across the load dropping resistor 60, and thereby the microcomputer 50 detects the value of the current passing through the heater 28 of the oxygen sensor 21. Further, the input I4 of the A/D converter 53 receives the voltage signal proportional to the current value of the supply voltage Vi (roughly the voltage being supplied by the battery 17), according to the operation of the aforementioned voltage divider circuit incorporating two resistors 61 and 62, and thereby the microcomputer 50 detects the value of the voltage Vi being supplied to the heater 28. From these values of the required power Pi, the available voltage Vi, and the actual heater current Ih when such a voltage Vi is being supplied, the microcomputer 50, which is going to apply a pulsed voltage supply of maximum voltage magnitude Vi to the heater 28 and at this amperage Ih in order to develop this power Wh, calculates the proper duty factor D for this pulsed voltage signal by using the equation $D=Wh/(Ih*Vi)$. And then the microcomputer 50 outputs a pulse signal with this duty factor D to the base of the transistor 54 from its output O1. In fact, of course, the voltage which is thereby supplied by the transistor 54 to the heater 28 will be slightly less than the supply voltage Vi of the battery 17, due to loss in the wiring harness and the like; but this small amount of voltage loss may be neglected. In any case, in this way, the signal to the base of the transistor 54 is a relatively high frequency signal, and the average current through the heater 28 increases as the duty ratio D increases towards unity. Using this duty factor, the heater 28 is driven with a mean current proportional to the required value. Thereby the desired power Wh is supplied.

Now, as mentioned previously, when a feedback control of the air/fuel ratio of the air-fuel mixture supplied to the engine 1 is to be provided, then the microcomputer 50 determines the oxygen amount in the exhaust gases of the engine from the signal from the oxygen sensor 21 as explained above, and applies a correction to the theoretically determined injected fuel value in order to produce a value for the actual amount of fuel to be injected, so as to bring the air/fuel ratio to its target value by a form of per se known feedback or closed loop control. On the other hand, when no such feedback correction according to exhaust oxygen concentration of the calculated theoretically proper amount of fuel to be injected in order to provide a proper and appropriate target value for the air/fuel ratio of the air-fuel mixture in the combustion chamber is being made, i.e. when the control of fuel injection is to be provided by a form of open loop control without any feedback, then instead the theoretically calculated injected fuel value is directly used as a value of fuel to be injected, said theoretical value optionally being reduced by a certain amount in order to ensure that the engine air/fuel ratio is controlled to be smaller than in the case when feedback is being utilized.

Now, the operation of this preferred embodiment of the oxygen sensor heating control system of the present invention, while performing the preferred embodiment of the oxygen sensor heating control method of the present invention, for selecting either the above described closed loop control method for controlling engine air/fuel ratio, or the above described open loop control method, will be explained, with reference to FIG. 4, which is a flow chart of the operation of certain parts of the program stored in the microcomputer 50. As will be seen, this selection between open loop control and closed loop control of the air/fuel ratio of the air-fuel mixture supplied to the engine 1 is performed according to the voltage Vi of the battery 17, and further employing a certain hysteresis so as to obtain stable control.

Figure 4:
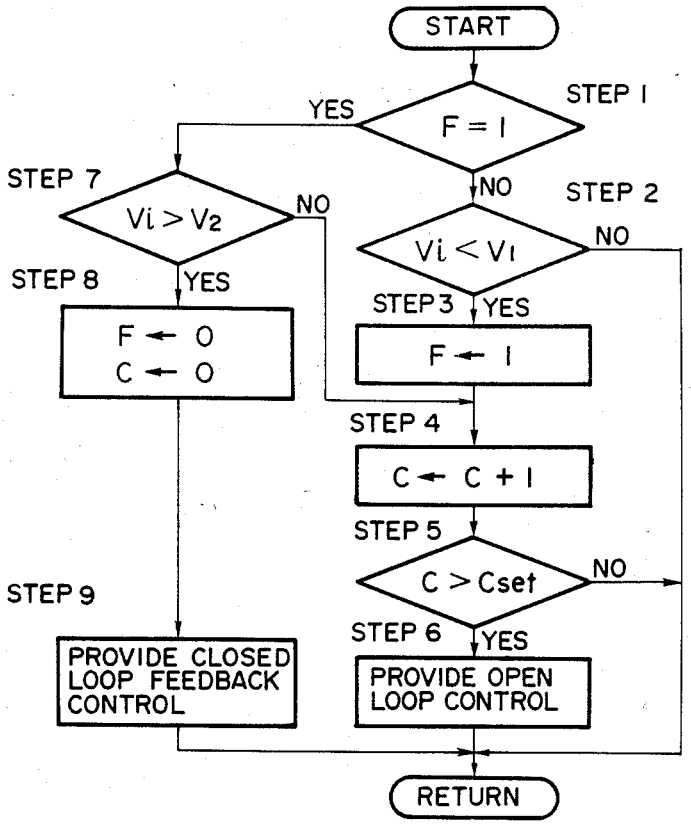
FIG. 4 is a flow chart of an interrupt subroutine for switching over between closed and open loop control operation for the air/fuel ratio of the air-fuel mixture supplied to the engine, stored in the memory of the microcomputer of FIG. 3 and executed by it at regular intervals during the practice of said preferred method embodiment.

The flow chart of FIG. 4 shows the operation of a mode switchover subroutine which is caused to be executed by the microcomputer 50 at fixed intervals, which are for example of the order of tens of milliseconds.

In this FIG. 4 subroutine, first, in the step 1, a decision is made as to whether the value of a flag F is unity, or not. As will be seen, the value of this flag F is zero if closed loop air/fuel ratio control is currently being performed, and is unity if open loop air/fuel ratio control is currently being performed. Initially, the value of F is set to be unity, and initially open loop control for air/fuel ratio is instituted. If the result of this decision is YES, so that currently open loop air/fuel ratio control is being performed, then the flow of control passes next to the step 7; whereas if the result of this decision is NO, so that currently closed loop air/fuel ratio control is being performed, then the flow of control passes next to the step 2.

In the step 2, at which point we know that currently closed loop air/fuel ratio control is being performed, a decision is made as to whether the voltage Vi of the battery 17 is less than a certain low value V1, or not. The value Vi of the battery voltage is determined by, as described above, selecting the input I4 of the A/D converter 53 (see FIG. 3), which receives a voltage representative of this battery voltage Vi. In this case, the A/D converter 53 sends an output pulse signal representative of the battery voltage Vi to the microcomputer 50. The threshold value V1 is determined to be such that, if the battery voltage Vi is less than it for a certain predetermined time, the heater 28 will no longer be able to keep the sensor element 22 of the oxygen sensor 21 at a proper operating temperature; and such a value for V1 may be decided upon by experiment. If the result of the decision in this step 2 is YES, so that it is determined that the voltage Vi from the battery 17 is currently inadequate, then the flow of control passes next to the step 3; whereas if the result of this decision is NO, so that it is deemed that the voltage Vi from the battery 17 is currently adequate, then the flow of control passes directly to the RETURN of this FIG. 4 subroutine, and no adjustments are made, thus leaving the current closed loop air/fuel ratio control unchanged.

On the other hand, if the flow of control passes next to the step 3, so that we know that the battery voltage Vi is at the moment inadequate, it next becomes necessary to consider for how long this battery voltage Vi has thus remained so low as to be insufficient. Therefore, the value of the flag F is set to unity, so as to signal the incipient start of open loop air/fuel ratio control (if this condition is maintained for a predetermined number of cycles of the FIG. 4 routine), and then control passes next to the step 4.

In this step 4, to which control can also be passed from the step 7 as will be seen hereinafter, the value of a count C is incremented (this count C is initially set to zero on transition to the closed loop form of air/fuel ratio control, in the step 8, as will be seen hereinafter), and then control is passed to the step 5.

Next, in the step 5, a decision is made as to whether the value of the count C has yet risen to be above a value Cset, or not. This value Cset corresponds to the number of executions of the FIG. 4 subroutine that are required to be performed, with the battery voltage Vi less than the threshold value V1, before the transition from closed loop control of the air/fuel ratio of the engine 1 to open loop control is made. If the result of this decision is NO, so that as many as Cset+1 repetitions of the FIG. 4 subroutine have not yet been performed since then the flow of control passes next to the step 7; whereas if the result of this decision is YES, so that now it is determined that the FIG. 4 subroutine has been executed Cset+1 times, then the flow of control passes next to the step 6.

In this step 6, since it is determined here that for Cset+1 repetitions of the FIG. 4 routine the voltage Vi of the battery 17 of the vehicle has been less than the threshold voltage V1, it has been ascertained that the heater 28 is not now able to keep the sensor element 22 of the oxygen sensor 21 at a proper operating temperature, and accordingly the output signal of this oxygen sensor 21 is no longer reliable for indicating the oxygen concentration in the exhaust gases of the engine 1. Accordingly, now, a flag or the like is set, for changing the method of control of the air/fuel ratio of the engine from the previous closed loop type to an open loop type of control, as explained previously. Then, after this, the flow of control is passed out of the FIG. 4 subroutine, via the RETURN thereof.

On the other hand, if from the step 1 the flow of control has been passed to the step 7, indicating that the value of the flag F is unity and accordingly currently open loop air/fuel ratio control is being performed, next a decision is made as to whether the voltage Vi of the battery 17 is less than a cetain value V2 which is somewhat higher than the previous value V1, or not. As before, the value Vi of the battery voltage is determined by selecting the input I4 of the A/D converter 53, so that the A/D converter 53 sends an output pulse signal representative of the battery voltage Vi to the microcomputer 50. The threshold value V1 is determined to be such that, if the battery voltage Vi has become greater than it, the heater 28 is now definitely able to keep the sensor element 22 of the oxygen sensor 21 at a proper operating temperature; and such a value for V2, again, may be decided upon by experiment. If the result of the decision in this step 2 is YES, so that it is determined that the voltage Vi from the battery 17 is currently adequate, then the flow of control passes next to the step 8; whereas if the result of this decision is NO, so that it is deemed that the voltage Vi from the battery 17 is not currently adequate, then the flow of control passes to the step 4, previously described, and the counting in the count C is continued. This counting up to the value Cset+1, at which value as explained above open loop air/fuel ratio control is started to be performed, is initiated by the voltage Vi of the battery 17 becoming less than the lower value V1, but thereafter continues as long as said voltage Vi stays less than the larger value V2; and hence some hysteresis in the operation of the routine of FIG. 4 is provided.

In the step 8, at which point it is definitely determined that now the voltage Vi from the battery 17 is adequate, the value of the count C is reset to zero, and also the value of the flag F is set to zero, to indicate that from now closed loop control of the air/fuel ratio of the air-fuel mixture supplied to the engine 1 is going to be performed; and then next the flow of control passes to the step 9, in which the aforementioned flag or the like is set, so as to change the method of control of the air/fuel ratio of the engine from the previous open loop type to a closed loop type of control, as explained previously. Again, after this, the flow of control is passed out of the FIG. 4 subroutine, via the RETURN thereof.

Thus, referring to FIG. 7, which is a timing chart showing, against time, for a particular exemplary operational episode, the voltage Vi being delivered by the battery 17, the temperature of the sensor element 22 of the oxygen sensor 21, and whether closed or open loop control is being provided for the air/fuel ratio of the air-fuel mixture supplied to the engine 1, the operation of the shown and described preferred embodiment of the present invention will be further clarified. In detail, at first at the origin time point, the temperature of the sensor element 22 is high enough for proper operation thereof, and also closed loop air/fuel ratio control is being performed by using the electrical output signal indicative of the oxygen concentration in the engine exhaust gases from this sensor element 22. As time passes from this origin time point, the voltage Vi of the battery 17 is seen to drop fairly steadily, until at the time point T1 it becomes lower than the first threshold value V1, so that at this time point T1 the counting in the counter C starts to take place. However, at this time point closed loop air/fuel ratio control is still kept as being practiced; this is reasonable, because as yet the sensor element 22 has not become too cold for proper operation thereof, although presumably it is now being inadequately heated by the heater element 28 which is receiving inadequate voltage for full and proper operation. The counting continues until the time point T2, at which time point the count C in the FIG. 4 routine becomes equal to the constant value Cset; it should be noted that during this time interval, of characteristic length t determined by the value of Cset, in fact the value of the battery voltage Vi fluctuates somewhat erratically and in fact rises above the first threshold value V1, passage below which had started the counting process, but this rising above the value V1 does not now halt the counting process, owing to the operational hysteresis provided by the operation of the FIG. 4 routine; the counting could only be interrupted by the battery voltage Vi rising to above the larger threshold value V2, which in the shown exemplary operational episode it does not. At this time point T2, then, the count C in the FIG. 4 routine becomes equal to the constant value Cset, and therefore at this time point T2 now open loop air/fuel ratio control starts to be performed, now without using the electrical output signal from the sensor element 22, which now cannot be relied upon as being indicative of the oxygen concentration in the engine exhaust gases, because now the sensor element 22 may have cooled down too much for proper operation, due to the poor heating that will now be being supplied to it by the heater 28. As time passes from this time point T2, with now open loop air/fuel ratio control being provided, the voltage Vi of the battery 17 is seen to rise somewhat erratically, until at the time point T3 it becomes greater than the second higher threshold value V2, so that at this time point T3 again closed loop air/fuel ratio control starts to be performed, with feedback again being based on the electrical output signal from the sensor element 22, which now can be considered as again bieng indicative of the oxygen concentration in the engine exhaust gases, since now the voltage Vi of the battery 17 is sufficient properly to operate the heater 28.

Figure 5:
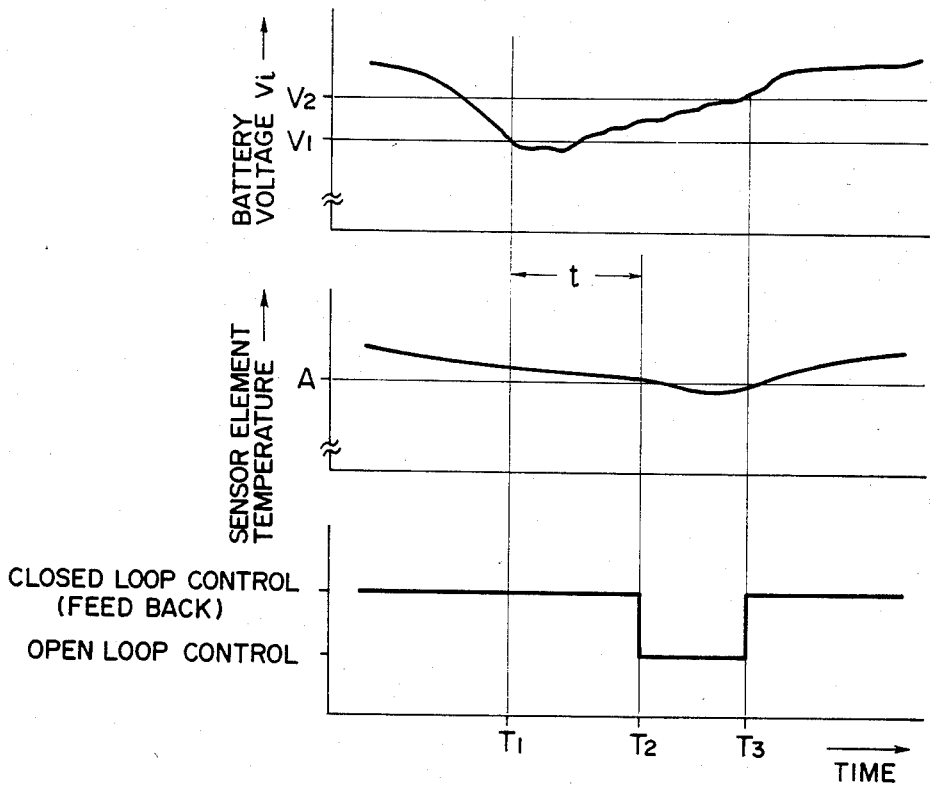
FIG. 5 is a time chart showing, against time, for a particular exemplary operational episode, the voltage being delivered by the battery of the vehicle incorporating this system, the temperature of the sensor element of the oxygen sensor, and whether closed or open loop control is being provided for the air/fuel ratio of the air-fuel mixture supplied to the engine.

Thus it is seen that, according to the method and system of the present invention, when the voltage of the power supply to the heater 28 drops below said first predetermined value V1 and stays thereafter below said second predetermined value V2 for longer than said predetermined time period t (as shown in FIG. 5), it is taken that the battery power supply has lost its voltage to the extent that by now it can no longer be powering said heater 28 so as properly to be heating up said oxygen sensor 21, and accordingly, if the output signal from said oxygen sensor 21 is continued to be used as an indication of oxygen concentration in the exhaust gases of the engine 1 for closed loop air/fuel ratio control, there is a risk of poor air/fuel ratio control, and of controlling the air/fuel ratio of the air-fuel mixture supplied to said engine 1 to be weaker than is desirable. Accordingly, according to the present method and system, in these circumstances the form of air/fuel ratio control is altered, so as to be now an open loop form of air/fuel ratio control which does not take into account the output signal from said oxygen sensor 21 as an indication of oxygen concentration in the exhaust gases of said engine 1. Thus, the engine 1 is operated in open loop air/fuel ratio control mode, until the above condition ceases to be the case, in other words, until the voltage of the battery 17 rises again to be above said second predetermined value V2; and when this happens closed loop feedback type air/fuel ratio control is resumed. The use of two such threshold values for the voltage of the battery 17, i.e. the use of the first and second predetermined values V1 and V2 with the second such value V2 larger than the first V1, is in order to provide stable system operation with a certain degree of operational hysteresis. In the open loop form of air/fuel ratio control operation, the air/fuel ratio of the air-fuel mixture supplied to the engine 1 may be lower, and accordingly the fuel consumption may be lowered, as compared with the closed loop feedback type operation; but as described above in the practice of the present invention such open loop operation is kept to the minimum practicable.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, although in the shown preferred embodiment the parameters according to which the fuel injection amount for the engine, and the amount of heater power provided for the oxygen sensor element heater, were engine intake manifold pressure and engine revolution speed, the present invention is not limited to this choice of parameters, and for example engine intake air flow and engine revolution speed could be utilized instead; other variations, such as throttle opening, are also possible for the chosen parameters. Other possible variations could be conceived of. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. For an internal combustion engine comprising an exhaust system and an oxygen sensor fitted to said exhaust system comprising a sensor element and an electrically powered heater for heating said sensor element:

a method for controlling the air/fuel ratio of the air-fuel mixture supplied to said engine, wherein:

when the voltage of the power supply to said heater has dropped below a first predetermined value and thereafter has remained below a second predetermined value higher than said first predetermined value for longer than a predetermined time period, said air/fuel ratio is controlled according to engine operational parameters by an open loop form of control with no account being taken of the output signal of said oxygen sensor; while, otherwise, said air/fuel ratio is controlled according to engine operational parameters by a closed loop form of control taking into account the output signal of said oxygen sensor, so as to obtain an optimum air/fuel ratio for the engine by a feedback control process.

2. A method for controlling heater electrical supply according to claim 1, wherein said open loop air/fuel ratio control provides a generally smaller air/fuel ratio than in the case of said closed loop air/fuel ratio control.

3. For an internal combustion engine comprising an exhaust system and an oxygen sensor fitted to said exhaust system comprising a sensor element and an electrically powered heater for heating said sensor element:

a system for controlling the air/fuel ratio of the air-fuel mixture supplied to said engine, comprising:

a first means for controlling said air/fuel ratio according to engine operational parameters by an open loop form of control with no account being taken of the output signal of said oxygen sensor;

a second means for controlling said air/fuel ratio according to engine operational parameters by a closed loop form of control taking into account the output signal of said oxygen sensor, so as to obtain an optimum air/fuel ratio for the engine by a feedback control process; and a means for, when the voltage of the power supply to said heater has dropped below a first predetermined value and thereafter has remained below a second predetermined value higher than said first predetermined value for longer than a predetermined time period, employing said first means for controlling said air/fuel ratio, and otherwise employing said second means for controlling said air/fuel ratio.

4. A system for controlling heater electrical supply according to claim 3, wherein said first means for controlling said air/fuel ratio by open loop control provides a generally smaller air/fuel ratio than does said second means for controlling said air/fuel ratio by closed loop control.

* * * * *

UNITED STATES PATENT AND TRADEMARK OFFICE

CERTIFICATE OF CORRECTION

PATENT NO. : 4,563,991

DATED : January 14, 1986

INVENTOR(S) : Takao Akatsuka et al.

It is certified that error appears in the above-identified patent and that said Letters Patent is hereby corrected as shown below:

Column 1, line 64, after "constant" insert a comma.

Column 2, line 10, change "condition" to --conditions--.

Column 3, line 11, change "control is" to --control in--.

Column 3, line 51, end paragraph with "control, which operate stably." Begin new paragraph with "It is a yet further object".

Column 4, line 18, change "a control" to --of control--.

Column 4, line 58, after "happens" insert a comma.

Column 7, line 27, change "desribed" to --described--.

Column 8, line 61, change "a RSTP" to --an RSTP--.

Column 8, line 62, delete hyphen after "Further,".

Column 9, line 21, "tor 5" should be --tor 55--.

UNITED STATES PATENT AND TRADEMARK OFFICE

CERTIFICATE OF CORRECTION

PATENT NO. : 4,563,991

DATED : January 14, 1986

INVENTOR(S) : Takao Akatsuka et al.

It is certified that error appears in the above-identified patent and that said Letters Patent is hereby corrected as shown below:

Column 14, line 26, omit the word "being" at the beginning of the line.

Column 14, line 35, change "bieng" to --being--.

Signed and Sealed this

*Twelfth* Day of *August 1986*

[SEAL]

*Attest:*

DONALD J. QUIGG

*Attesting Officer*

*Commissioner of Patents and Trademarks*